US010838319B2

(12) United States Patent
Mori et al.

(10) Patent No.: US 10,838,319 B2
(45) Date of Patent: Nov. 17, 2020

(54) SCANNING APPARATUS AND IMAGE FORMING APPARATUS THAT PERFORM EMISSION CONTROL OF LASER BEAMS

(71) Applicant: CANON KABUSHIKI KAISHA, Tokyo (JP)

(72) Inventors: Atsunobu Mori, Suntou-gun (JP); Tatsuya Hotogi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/410,968

(22) Filed: May 13, 2019

(65) Prior Publication Data

US 2019/0354034 A1 Nov. 21, 2019

(30) Foreign Application Priority Data

May 18, 2018 (JP) ..... 2018-096082

(51) Int. Cl.
*G03G 15/043* (2006.01)

(52) U.S. Cl.
CPC ..... *G03G 15/043* (2013.01)

(58) Field of Classification Search
CPC ..... G03G 15/04072; G03G 15/043
See application file for complete search history.

(56) References Cited

U.S. PATENT DOCUMENTS

| | | | | |
|---|---|---|---|---|
| 5,864,355 | A | 1/1999 | Bush et al. | 347/235 |
| 6,064,419 | A | 5/2000 | Uchiyama | 347/250 |
| 8,400,698 | B2 | 3/2013 | Fujii et al. | 359/199.1 |
| 9,041,757 | B2 * | 5/2015 | Hayakawa | G03G 15/80 347/237 |
| 9,400,444 | B2 * | 7/2016 | Sato | G02B 26/127 |
| 10,095,155 | B2 | 10/2018 | Hotogi et al. | G03G 15/04036 |
| 2012/0195610 | A1 * | 8/2012 | Fujishiro | G03G 15/043 399/51 |
| 2016/0170324 | A1 * | 6/2016 | Maeda | G03G 15/043 347/118 |
| 2016/0187806 | A1 * | 6/2016 | Kawana | H04N 1/04 399/51 |
| 2018/0017889 | A1 * | 1/2018 | Seki | H04N 1/40056 |
| 2019/0219944 | A1 * | 7/2019 | Akizuki | G03G 15/0415 |

FOREIGN PATENT DOCUMENTS

| | | |
|---|---|---|
| JP | H01-93766 | 4/1989 |
| JP | H08-183198 | 7/1996 |
| JP | 2002-023096 | 1/2002 |
| JP | 2002-244055 | 8/2002 |

* cited by examiner

*Primary Examiner* — Francis C Gray
(74) *Attorney, Agent, or Firm* — Venable LLP

(57) ABSTRACT

The scanning apparatus and the image forming apparatus include a semiconductor laser emitting laser light for forming an electrostatic latent image according to image data on a photosensitive drum, a rotary polygon mirror scanning the laser light emitted from the semiconductor laser by rotation, a horizontal synchronization sensor arranged in a non-image area, and outputting a signal in response to the laser light being emitted, and a CPU performing intermittent emission control that causes the semiconductor laser to be emitted in an area in which the laser light is emitted to the horizontal synchronization sensor based on a BD cycle, the CPU switches the intermittent emission control based on the BD signal by a time the rotary polygon mirror reaches a target rotation speed.

17 Claims, 13 Drawing Sheets

SCANNING APPARATUS AND IMAGE FORMING APPARATUS THAT PERFORM EMISSION CONTROL OF LASER BEAMS

BACKGROUND OF THE INVENTION

Field of the Invention

The present invention relates to a scanning apparatus and an image forming apparatus, and relates to the start-up control of the scanning apparatus used in the image forming apparatus, such as an electrophotography printer that performs image exposure by a laser beam.

Description of the Related Art

Conventionally, as disclosed in, for example, the specification of U.S. Pat. No. 5,864,355, the technology is proposed that restricts an emission permission area for laser to a non-image area of the entire scan area at the time of start-up of a scanning apparatus that forms a latent image by emitting laser light on a photosensitive member. Additionally, as disclosed in, for example, Japanese Patent Application Laid-Open No. H08-183198, the technology is proposed that controls the rotation speed of a rotary polygon mirror of a scanning apparatus by using a horizontal synchronization signal period.

SUMMARY OF THE INVENTION

An aspect of the present invention is to provide a scanning apparatus in which the start-up time is reduced.

Another aspect of the present invention is to provide a scanning apparatus that is started up while laser light is emitted only in an area where a horizontal synchronization signal is generated.

A further aspect of the present invention is to provide a scanning apparatus including a light source configured to emit laser light for forming an electrostatic latent image according to image data onto a photosensitive member, a rotary polygon mirror configured to scan the laser light emitted from the light source by rotation, an output unit arranged in a second area except for a first area corresponding to an area in which the electrostatic latent image is formed in an area to which the laser light is scanned, the output unit being configured to output a signal in response to emission of the laser light, and a control unit configured to perform intermittent emission control in which the light source emits a laser light in the area in which the laser light is emitted to the output unit, based on a cycle of the signal output by the output unit, wherein the control unit switches the intermittent emission control based on the signal by a time the rotary polygon mirror reaches a target rotation speed.

A still further aspect of the present invention is to provide an image forming apparatus including a scanning apparatus, a photosensitive member on which an electrostatic latent image is formed by scanning laser light by the scanning apparatus, a developing unit configured to develop the electrostatic latent image formed on the photosensitive member with a toner, and to form a toner image, and a transfer unit configured to transfer the toner image formed by the developing unit to a recording material, the scanning apparatus including a light source configured to emit the laser light for forming the electrostatic latent image according to image data onto the photosensitive member, a rotary polygon mirror configured to scan the laser light emitted from the light source by rotation, an output unit arranged in a second area except for a first area corresponding to an area in which the electrostatic latent image is formed in an area to which the laser light is scanned, the output unit being configured to output a signal in response to emission of the laser light, and a control unit configured to perform intermittent emission control in which the light source emits a laser light in the area in which the laser light is emitted to the output unit, based on a cycle of the signal output by the output unit, wherein the control unit switches the intermittent emission control based on the signal by a time the rotary polygon mirror reaches a target rotation speed.

Further features of the present invention will become apparent from the following description of exemplary embodiments with reference to the attached drawings.

DESCRIPTION OF THE EMBODIMENTS

Figure 1A:
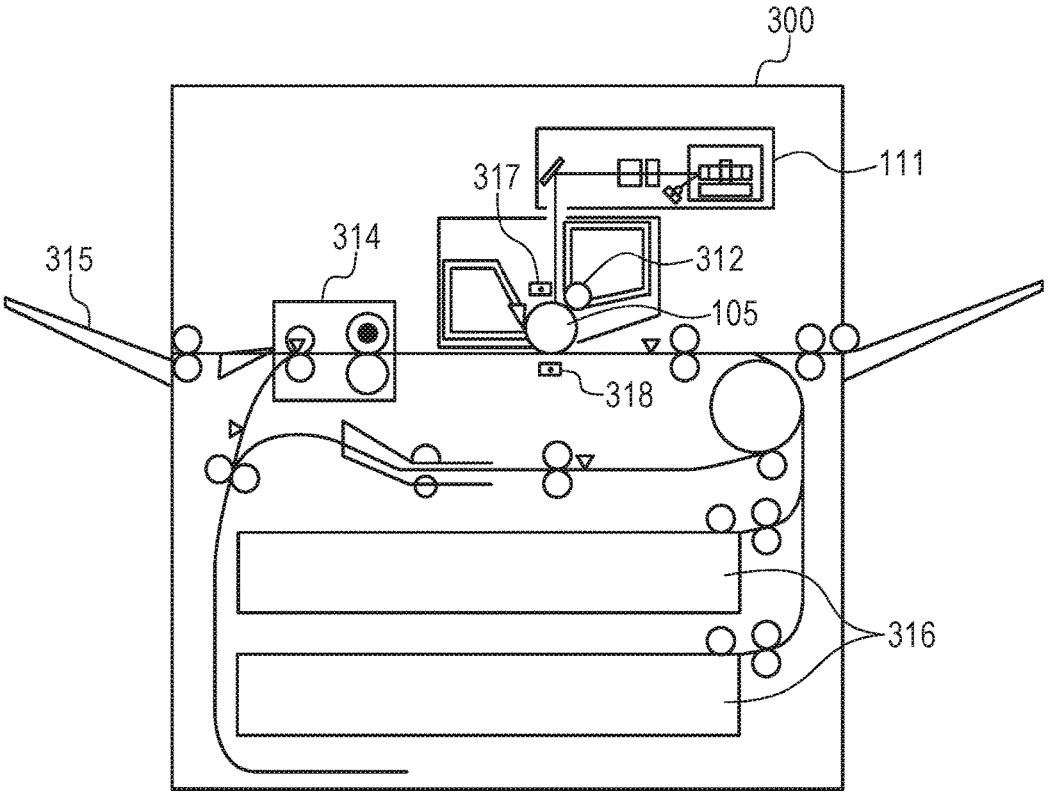
FIG. 1A and FIG. 1B are diagrams illustrating the schematic configuration of an image forming apparatus and a scanning apparatus of Examples 1 to 4.

Preferred embodiments of the present invention will now be described in detail in accordance with the accompanying drawings.

Referring to the drawings, modes for carrying out the present invention are exemplarily described below in detail based on examples. However, the sizes, materials and shapes of components described in the embodiments and their relative arrangements should be properly modified according to the configuration of an apparatus to which the invention is applied and according to various conditions. That is, the present invention is not intended to be limited to the following embodiments.

Example 1

(Configuration of Image Forming Apparatus)

As an example of an image forming apparatus, a laser beam printer is described as an example. FIG. 1A illustrates the schematic configuration of the laser beam printer, which is an example of a printer using the electrophotography method. A laser beam printer 300 (hereinafter referred to as the printer 300) includes a scanning apparatus 111, a photosensitive drum 105, which is a photosensitive member, a charge unit 317 (charge device), and a developing unit 312 (developing device). The scanning apparatus 111 forms an electrostatic latent image on the photosensitive drum 105. The charge unit 317 uniformly charges the photosensitive drum 105 before the electrostatic latent image is formed. The developing unit 312 develops the electrostatic latent image formed on the photosensitive drum 105 with a toner. Then, a toner image developed on the photosensitive drum 105 is transferred by a transfer unit 318 (transfer device) to a sheet (not shown) as a recording material supplied from cassettes 316, and the toner image transferred to the sheet is fixed by a fixing device 314, and is discharged to a tray 315. This photosensitive drum 105, the charge unit 317, the developing unit 312, and the transfer unit 318 form an image forming portion. The image forming apparatus to which the present invention can be applied is not limited to the image forming apparatus illustrated in FIG. 1A, and may be, for example, a color image forming apparatus including a plurality of image forming portions. Further, the image forming apparatus may be a color image forming apparatus including a primary transfer unit that transfers the toner image on the photosensitive drum 105 to an intermediate transfer belt, and a secondary transfer unit that transfers the toner image on the intermediate transfer belt to a sheet.

(Configuration of Laser Scanner Unit)

Figure 1B:
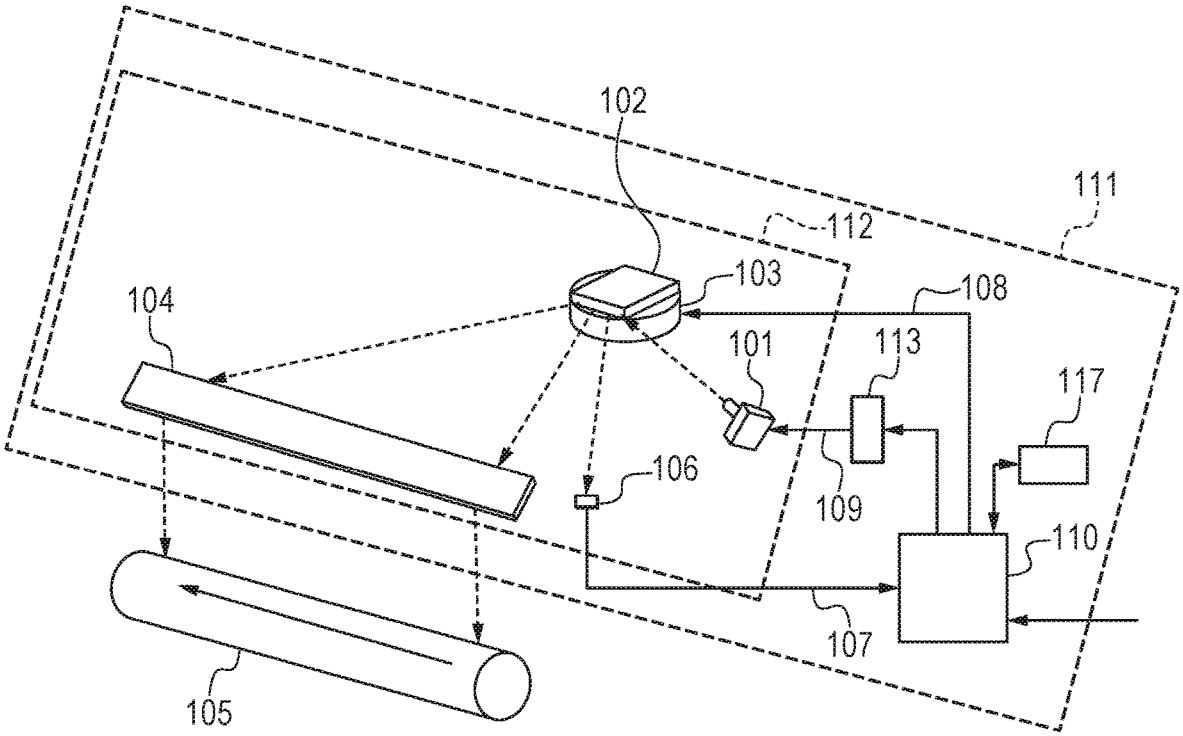

FIG. 1B is a perspective view of the scanning apparatus 111 common to each example, and a laser scanner unit 112 that is the main part. A semiconductor laser 101 is a light source for image exposure. A rotary polygon mirror 102 reflects laser light from the semiconductor laser 101, and makes the laser light emitted on a surface of the photosensitive drum 105, which is an example of a photosensitive member, via a reflective mirror 104. A scanner motor 103 is an example of a rotary driving unit rotating the rotary polygon mirror 102, rotates the rotary polygon mirror 102, and makes the laser light from the semiconductor laser 101 scan on the photosensitive drum 105. The scanning direction of the laser light is also called a main scanning direction. Accordingly, an electrostatic latent image is formed on the photosensitive drum 105. The area corresponding to an area in which the electrostatic latent image is formed on the photosensitive drum 105 in an area scanned by the laser light by the rotary polygon mirror 102 is called an image area, which is a first area. Additionally, the area other than the image area to which image data is not output in the area scanned by the laser light by the rotary polygon mirror 102 is called a non-image area, which is a second area. A horizontal synchronization sensor 106, which is an output device, is arranged in the non-image area. The horizontal synchronization sensor 106 generates a horizontal synchronization signal 107 at the timing when the laser light is emitted to the position of the horizontal synchronization sensor 106. The horizontal synchronization signal 107 is generated for every scan of the laser light, and the interval between the horizontal synchronization signals 107 (the cycle of the horizontal synchronization signal 107) is equivalent to the time period of one scan of the laser light.

Note that, hereinafter, the horizontal synchronization signal 107 is expressed as a beam detection signal (hereinafter, the BD signal) 107, and the interval between the BD signals 107 is expressed as a "BD cycle" as the cycle of the BD signal. Additionally, the BD signal 107 is used as a reference signal for starting scanning in the main scanning direction, and is used as a writing starting position in the main scanning direction. A CPU 110 is an example of a control device, and every time the BD signal 107 is generated, updates the BD cycle and stores the BD cycle in a storing unit 117. The CPU 110 has a timer function, and is configured to calculate the time period after the BD signal 107 is detected until the next BD signal 107 is detected as the BD cycle. Additionally, the CPU 110 has a speed control function for converging a scanner motor 103 to a target rotation frequency (corresponding to a target rotation speed), based on a current BD cycle that is read from the storing unit 117. The CPU 110 controls the scanner motor 103 by a scanner motor driving signal 108 with the speed control function.

A laser drive circuit 113 adjusts the amount of light used as the reference for the laser light emitted during image formation, based on a detection result of a monitor element (not shown), such as a photodiode (PD) that receives the laser light emitted from the semiconductor laser 101. The laser drive circuit 113 adjusts the amount of light of the semiconductor laser 101 in the non-image area of the scan area of the laser light, and functions as an adjustment device. Additionally, the laser drive circuit 113 also performs control of turning on or turning off the semiconductor laser 101 according to the image data for performing image formation. The CPU 110 has a function of performing emission control of the semiconductor laser 101 by using a laser driving signal 109 via the laser drive circuit 113, based on the current BD cycle stored in the storing unit 117.

(Description of the Operation for Performing Start-Up from the State where the Scanner Motor 103 is Stopped)

Figure 2A:
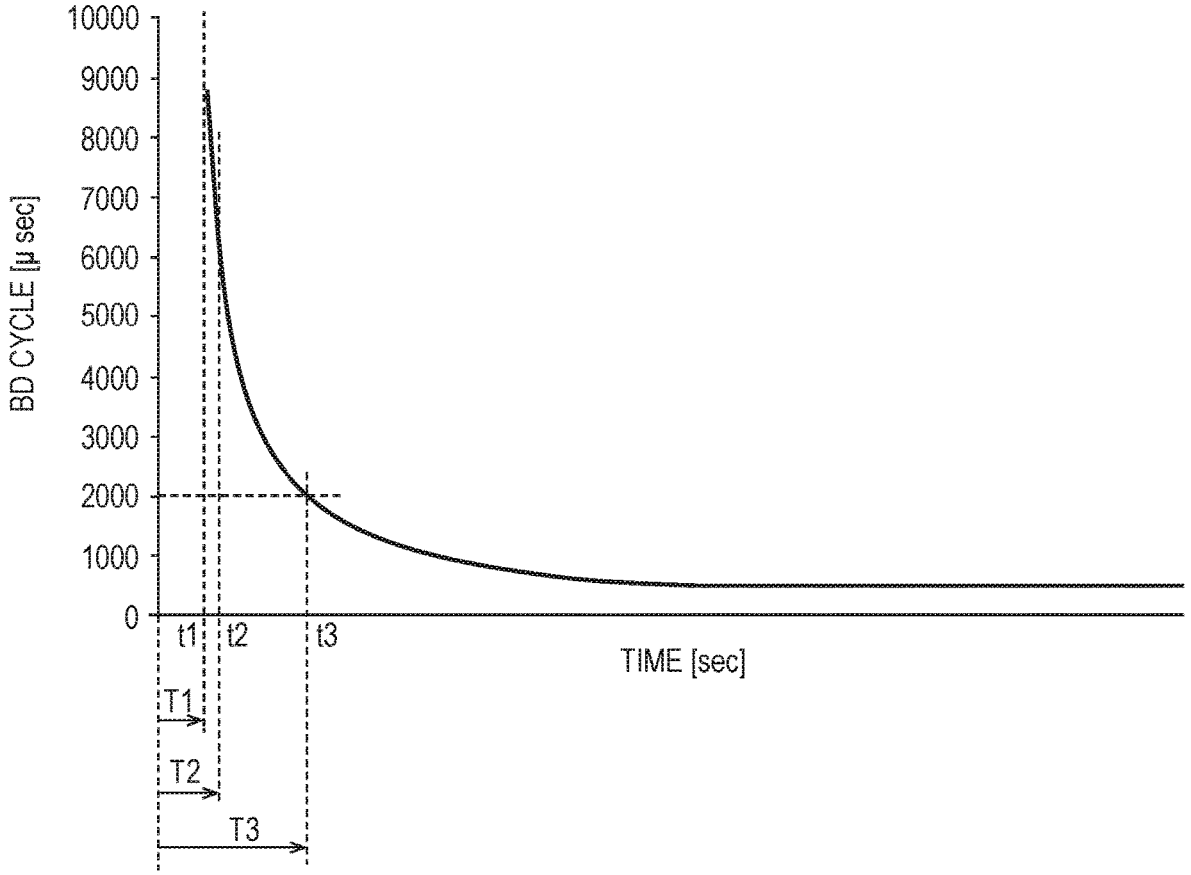
FIG. 2A is a graph illustrating a BD cycle of Example 1.
Figure 2B:
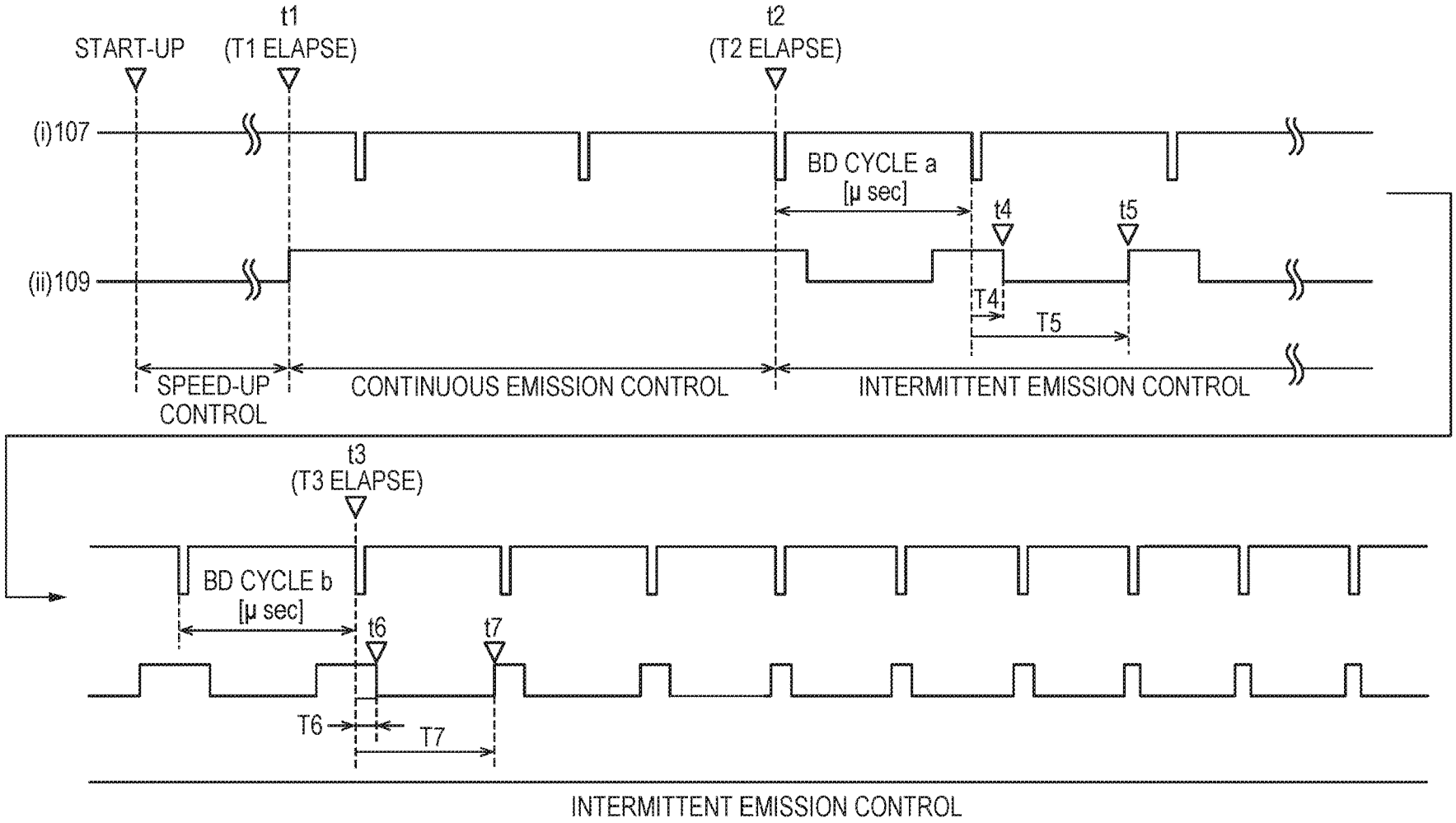
FIG. 2B is a timing chart illustrating the waveforms of a BD signal and a laser driving signal.

Using FIG. 2A and FIG. 2B, the operation of start-up control from the state where the scanner motor 103 of Example 1 is stopped is described. The scanner motor 103, in other words, the rotary polygon mirror 102, is speeded up until the target rotation speed is reached when the start-up is started. FIG. 2A is a characteristic diagram illustrating the change of the BD cycle in a case where the scanner motor 103 is started up from the state where the scanner motor 103 is stopped. A horizontal axis represents the time [sec (second)], and a vertical axis represents the BD cycle [μsec]. FIG. 2B illustrates the timings of the BD signal 107 and the laser driving signal 109. In FIG. 2B, (i) illustrates the waveform of the BD signal 107, (ii) illustrates the waveform of the laser driving signal 109, and a horizontal axis represents the time. As illustrated in FIG. 2B, the BD signal 107 is a negative logic, and the CPU 110 detects the interval between the falling edges of the BD signal 107 as the BD cycle. Additionally, the laser driving signal 109 is positive logic, and when the laser driving signal 109 is at a high-level, the semiconductor laser 101 emits light.

First, when the printer 300 receives a print instruction, the CPU 110 starts the start-up of the scanning apparatus 111 (start-up is started). The CPU 110 performs speed-up control by giving a speed-up instruction during a time period T1 until a time t1 to the scanner motor 103, by using the scanner motor driving signal 108 at a predetermined timing from the print instruction. After the time t1, continuous emission control is performed on the semiconductor laser 101 by the laser driving signal 109. Accordingly, the BD signal 107 is generated at the timing at which the laser light is input to the horizontal synchronization sensor 106, and the CPU 110 obtains the BD signal 107. Hereinafter, obtaining the BD signal 107 by the CPU 110 is referred to as detecting the BD signal 107. After the time t1, the BD cycle generated by the horizontal synchronization sensor 106 becomes short due to the speed-up of the scanner motor 103 (see T1 to T2 of FIG. 2A). In Example 1, the CPU 110 moves from the continuous emission control to intermittent emission control of the semiconductor laser 101, after a time t2 when the CPU 110 detects the BD signal 107 three times as illustrated in FIG.

2B. The intermittent emission control refers to the control of emitting the semiconductor laser 101 only at the timing when the laser light is emitted to the horizontal synchronization sensor 106. Further, it is assumed that a time period T2 has elapsed by the time t2 since starting the start-up of the scanning apparatus 111. As for the number of times (a predetermined number of times) of detection of the BD signal 107 that moves to the intermittent emission control, the number of times may be twice or more with which the BD cycle can be detected. Additionally, after the time t2, the CPU 110 performs speed control of the scanner motor 103 by using the scanner motor driving signal 108, so that the BD cycle is converged to a target cycle.

Subsequently, the intermittent emission control is described. In the period from the time t2 to a time t3 illustrated in FIG. 2A and FIG. 2B, the BD cycle becomes a predetermined threshold value (a predetermined cycle), for example, 2000 μsec or more. Therefore, the CPU 110 calculates a time period T4 until emission of the semiconductor laser 101 is ended (emission end), and a time period T5 until the emission is started (emission start) with the following Formulas (1) and (2) by using a BD cycle at the last scan. Note that the time period T4 is a time period until the laser driving signal 109 is switched from a high level to a low level since the BD signal 107 is detected, and the time t4, which is a first timing, is the timing at which the semiconductor laser 101 is turned off. The time period T5 is a time period until the laser driving signal 109 is switched from the low level to the high level since the BD signal 107 is detected, and the time t5, which is a second timing, is the timing at which the semiconductor laser 101 is turned on. Here, $K_1$ and $K_2$ are coefficients, and in Example 1, it is assumed that $K_1$:0.004 (a first coefficient) and $K_2$:0.93 (a second coefficient), for example, and the BD cycle is multiplied by these coefficients. The coefficient $K_2$ is a value smaller than 1.

$$\text{Time until emission end} = \text{the BD cycle at the last scan} \times K_1 \quad \text{Formula (1)}$$

$$\text{Time until emission start} = \text{the BD cycle at the last scan} \times K_2 \quad \text{Formula (2)}$$

Next, after a time t3 in FIG. 2A, the BD cycle becomes shorter than 2000 μsec. The time t3 is a time when a time period T3 has elapsed since starting the start-up of the scanner motor 103 (see FIG. 2A). Therefore, the CPU 110 calculates a time period T6 until the emission end of the semiconductor laser 101, and a time period T7 until the emission start with the following Formulas (3) and (4), which are different from Formulas (1) and (2), by using a BD cycle b at the last scan. Note that the time period T6 is a time period until the laser driving signal 109 is switched from the high level to the low level since the BD signal 107 is detected, and the time t6, which is a third timing, is the timing at which the semiconductor laser 101 is turned off. The time period T7 is a time period until the laser driving signal 109 is switched from the low level to the high level since the BD signal 107 is detected, and the time t7, which is a fourth timing, is the timing at which the semiconductor laser 101 is turned on.

$$\text{Time until emission end} = \text{the BD cycle at the last scan} \times K_3 \quad \text{Formula (3)}$$

$$\text{Time until emission start} = \text{the BD cycle at the last scan} \times K_4 \quad \text{Formula (4)}$$

Here, $K_3$ and $K_4$ are coefficients, and in Example 1, it is assumed that $K_3$:0.011 (a third coefficient), and $K_4$:0.97 (a fourth coefficient).

In Example 1, by making the coefficient $K_2$<the coefficient $K_4$ as described above, in the early stage of start-up of the scanner motor 103 in which the change in the BD cycle is large, the semiconductor laser 101 is controlled to be turned on with respect to a generation area of the BD signal 107 at an early timing. Accordingly, in the early stage of start-up of the scanner motor 103, emission to the horizontal synchronization sensor 106 can be positively performed. Additionally, by making the coefficient $K_1$<coefficient $K_3$, in the early stage of start-up of the scanner motor 103, after obtaining the BD signal 107, the semiconductor laser 101 is controlled to be turned off at an early timing. Accordingly, in the early stage of start-up of the scanner motor 103, the laser emission in the image area can be avoided. Further, switching of the calculation formulas may be performed multiple times during the start-up of the scanner motor 103. Additionally, the average value of the BD cycles obtained multiple times may be used as the threshold value. Further, although the coefficient $K_1$ and the coefficient $K_3$ are set to be different values, the coefficient $K_1$ and the coefficient $K_3$ may be the same value. That is, when the BD signal 107 is able to be detected irrespective of the rotation speed of the scanner motor 103, the semiconductor laser 101 may be controlled to be turned off quickly. For example, each of the coefficient $K_1$ and the coefficient $K_3$ may be set to 0.004.

(Description of the Operation of Restarting Up the Scanner Motor 103)

Figure 3A:
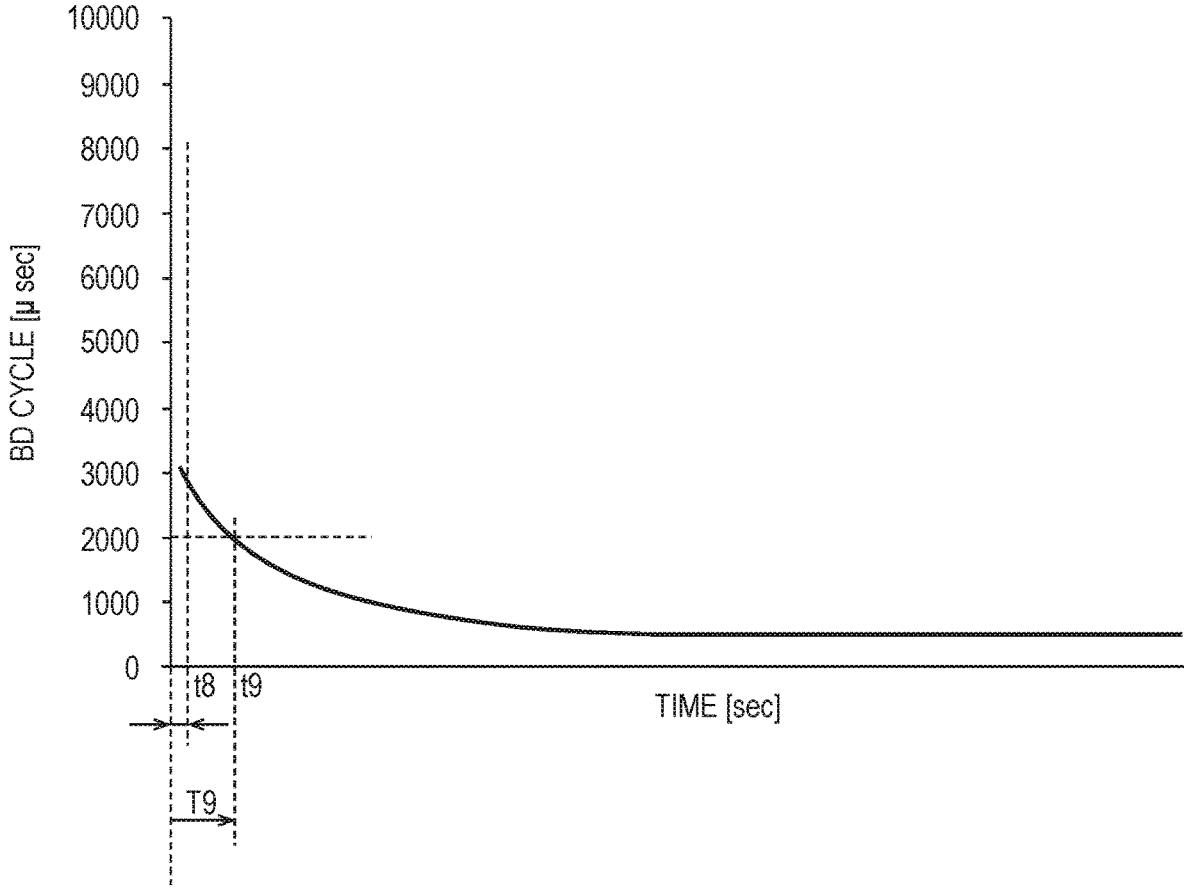
FIG. 3A is a graph illustrating the BD cycle of Example 1.
Figure 3B:
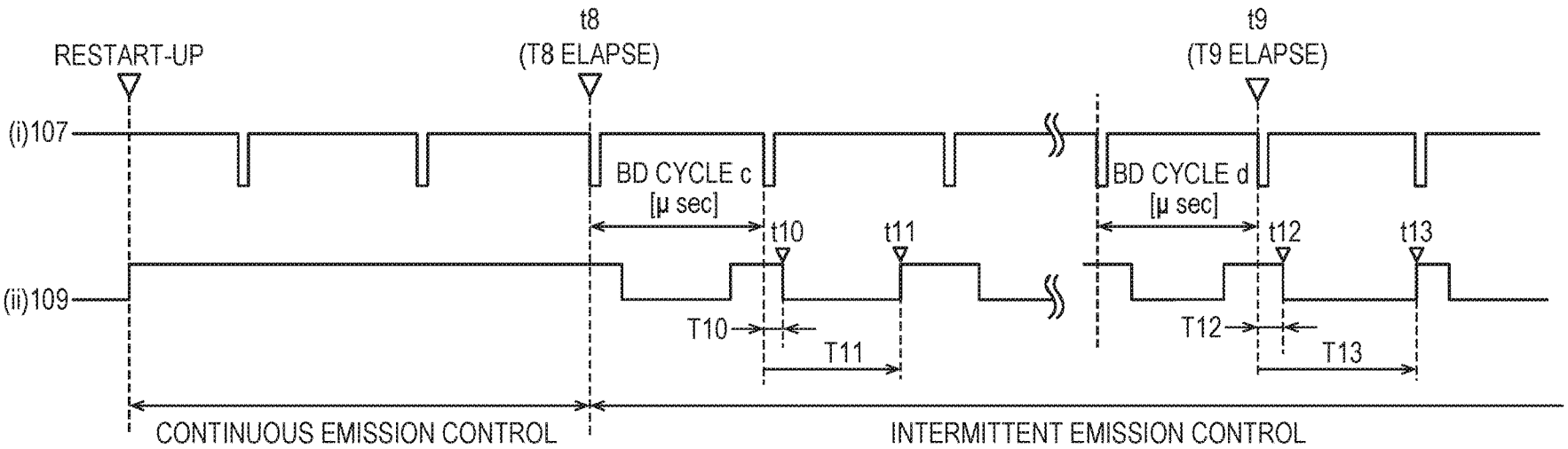
FIG. 3B is a timing chart illustrating the waveforms of the BD signal and the laser driving signal.

Using FIG. 3A and FIG. 3B, the operation in a case where the scanner motor 103 in Example 1 is restarted up before being stopped is described. FIG. 3A is an example of a characteristic diagram illustrating the change of the BD cycle in a case where the scanner motor 103 is restarted up before being stopped. A horizontal axis represents the time [sec], and a vertical axis represents the BD cycle [μsec].

First, when the printer 300 receives the print instruction, the CPU 110 starts the restart-up of the scanning apparatus 111 (restart-up). The CPU 110 performs speed-up control by giving a speed-up instruction to the scanner motor 103 by using the scanner motor driving signal 108 at a predetermined timing from the print instruction. The CPU 110 performs continuous emission control of the semiconductor laser 101 with the laser driving signal 109, together with the speed-up control of the scanner motor 103, and obtains the BD signal 107. In Example 1, as illustrated in FIG. 3B, the CPU 110 moves from the continuous emission control to the intermittent emission control for the control of the semiconductor laser 101 after a time t8 when the CPU 110 detects the BD signal 107 three times. Further, it is assumed that a time period T8 has elapsed by the time t8 since the restart-up of the scanning apparatus 111. As for the number of times of detection of the BD signal 107 that moves to the intermittent emission control, the number of times may be twice or more with which the BD cycle can be detected. Additionally, after the time t8, the CPU 110 performs speed control of the scanner motor 103 by using the scanner motor driving signal 108, so that the BD cycle is converged to a target cycle.

Subsequently, a description about the intermittent emission control is added. In the period from the time t8 to a time t9 illustrated in FIG. 3A and FIG. 3B, the BD cycle becomes 2000 μsec or more. Therefore, the CPU 110 computes a time period T10 until the emission end and a time period T11 until the emission start of the semiconductor laser 101 with the above-described Formulas (1) and (2) by using the BD cycle c at the last scan. Note that the time period T10 is a time period until the laser driving signal 109 is switched from the high level to the low level since the BD signal 107 is detected. The time period T11 is a time period until the laser driving signal 109 is switched from the low level to the high level since the BD signal 107 is detected. The same value is used for the coefficients $K_1$ and $K_2$.

Next, after the time t9 in FIG. 3A, the BD cycle becomes shorter than 2000 μsec. The time t9 is a time when the time period T9 has elapsed since the restart-up of the scanner motor 103 (see FIG. 3A). Therefore, the CPU 110 computes a time period T12 until the emission end and a time period T13 until the emission start of the semiconductor laser 101 with Formulas (3) and (4) by using a BD cycle d at the last scan. The same value is used for the coefficients $K_3$ and $K_4$.

In this manner, even at the time of restart-up of the scanner motor 103, by switching the calculation formula for computing the emission timing of the semiconductor laser 101 according to the BD cycle, the emission to the horizontal synchronization sensor 106 is positively enabled. Note that, as for the coefficients $K_1$ to $K_4$, different values may be used for a case where the scanner motor 103 is restarted up, and a case where the scanner motor 103 is started up from a state where the scanner motor 103 is stopped.

(Description of Flowchart)

Figure 4:
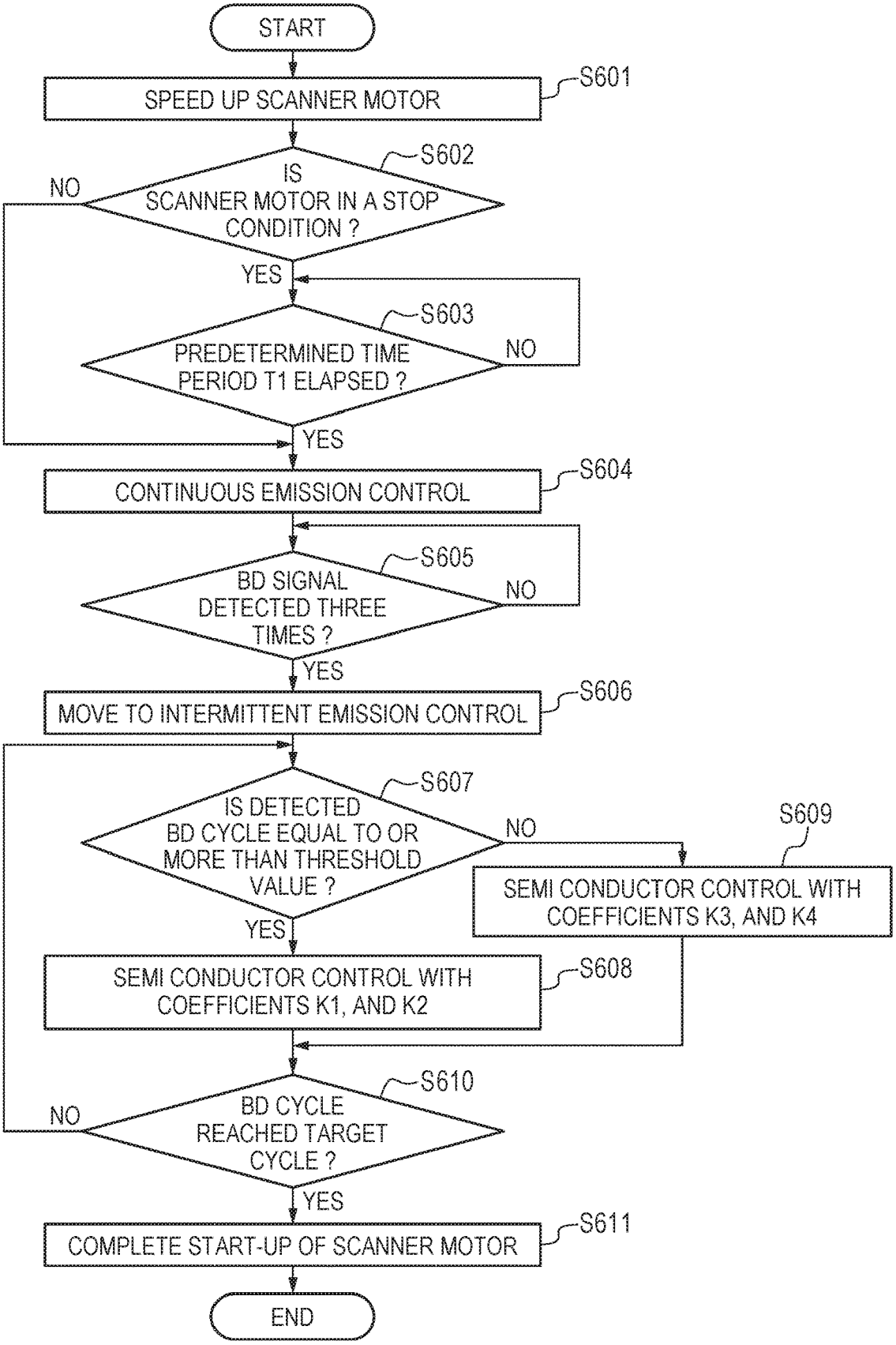
FIG. 4 is a flowchart illustrating the processing at the time of start-up of the scanning apparatus of Example 1.

Next, using the flowchart of FIG. 4, the start-up control of the scanner motor 103 by the CPU 110 of Example 1 is described. Note that a predetermined time period is required until the scanner motor 103 is actually stopped after the CPU 110 outputs the scanner motor driving signal 108 for stopping (the signal for turning off) the scanner motor 103. Therefore, the CPU 110 determines the rotation state of the scanner motor 103 at the time of the restart-up, based on an elapsed time until the scanner motor 103 is restarted up after outputting the scanner motor driving signal 108 for stopping the scanner motor 103. Therefore, it is assumed that the CPU 110 measures the elapsed time after outputting the scanner motor driving signal 108 for stopping the scanner motor 103 with a timer (not shown).

When printing is instructed, the CPU 110 starts the processing after step (hereinafter referred to as S) 601. At S601, the CPU 110 starts speed-up of the scanner motor 103 with the scanner motor driving signal 108. At S602, the CPU 110 determines whether or not a time period has elapsed during which it is estimated that the scanner motor 103 is completely stopped after outputting the scanner motor driving signal 108 for stopping the scanner motor 103, by referring to the timer. In other words, the CPU 110 determines whether or not the scanner motor 103 is in a state where the scanner motor 103 is stopped (stop condition). It is assumed that the time period during which it is estimated that the scanner motor 103 is completely stopped after outputting the scanner motor driving signal 108 for stopping the scanner motor 103 is calculated in advance by, for example, an experiment, and is stored in the storing unit 117.

At S602, when the CPU 110 determines that the time period during which it is estimated that the scanner motor 103 is completely stopped has elapsed, that is, determines that the scanner motor 103 is stopped, the processing proceeds to S603. At S603, the CPU 110 determines whether or not the predetermined time period T1 (predetermined time period) has elapsed since starting the start-up of the scanner motor 103. At S603, when the CPU 110 determines that the predetermined time period T1 has elapsed, the processing proceeds to S604. At S603, when the CPU 110 determines that the predetermined time period T1 has not elapsed, the processing returns to S603. At S602, when the CPU 110 determines that the scanner motor 103 is not in the stop condition, that is, the scanner motor 103 is restarted up when still rotating, the processing proceeds to S604. At S604, the CPU 110 performs the continuous emission control of the semiconductor laser 101. The CPU 110 resets a counter (not shown) that counts the number of times the BD signal 107 is detected, and counts up the counter every time the BD signal 107 is detected.

At S605, the CPU 110 determines whether or not the BD signal 107 is detected three times, by referring to the counter. At S605, when the CPU 110 determines that the BD signal 107 is detected three times, the processing proceeds to S606, and when the CPU 110 determines that the BD signal 107 is not detected three times, the processing returns to S605. At S606, the CPU 110 moves to the intermittent emission control of the semiconductor laser 101. At S607, the CPU 110 determines whether or not the detected BD cycle is equal to or more than the threshold value. In the case of Example 1, as described above, 2000 μsec is used as the threshold value of the BD cycle.

At S607, when the CPU 110 determines that the BD cycle is equal to or more than 2000 μsec (equal to or more than the predetermined cycle), the processing proceeds to S608, and when the CPU 110 determines that the BD cycle is less than 2000 μsec (less than the predetermined cycle), the processing proceeds to S609. At S608, as indicated by Formulas (1) and (2), the CPU 110 computes the emission start and end timings of the semiconductor laser 101 with the coefficients $K_1$ and $K_2$, and controls the semiconductor laser 101. At S609, as indicated by Formulas (3) and (4), the CPU 110 computes the emission start and end timings of the semiconductor laser 101 with the coefficients $K_3$ and $K_4$, and controls the semiconductor laser 101.

At S610, the CPU 110 determines whether or not the BD cycle has reached the target cycle. At S610, when the CPU 110 determines that the BD cycle has reached the target cycle, the processing proceeds to S611, and when the CPU 110 determines that the BD cycle has not reached the target cycle, the processing returns to S607. At S611, the CPU 110 completes the start-up of the scanner motor 103, and the processing ends.

As described above, according to Example 1, the calculation formulas for computing the emission start and end timings of the semiconductor laser 101 are switched according to the BD cycle at the time of start-up of the scanner motor 103. Accordingly, even in the early stage of start-up of the scanner motor 103 in which the BD cycle is significantly changed, the emission to the horizontal synchronization sensor 106 can be positively performed. Additionally, a device to avoid the laser emission to the image area can be further provided in the early stage of start-up of the scanner motor 103.

As described above, according to Example 1, the laser can be turned on in the area in which the horizontal synchronization signal is generated at the time of start-up of the scanning apparatus.

Example 2

In Example 2, the calculation formulas for computing the emission start and end timings of the semiconductor laser 101 are switched according to the amount of change of the BD cycle. Accordingly, even if the acceleration at the time of increasing the speed of the scanner motor 103 to a target rotation speed (hereinafter referred to as the speed increasing slope) is changed according to the environmental variation or the secular change, the emission of the laser light to the horizontal synchronization sensor 106 is enabled. Further, since the configuration of the laser scanner unit in Example 2 is similar to the configuration of the laser scanner unit in Example 1, a description is omitted.

(Description of the Operation of Performing Start-Up from the State where the Scanner Motor 103 is Stopped)

Figure 5A:
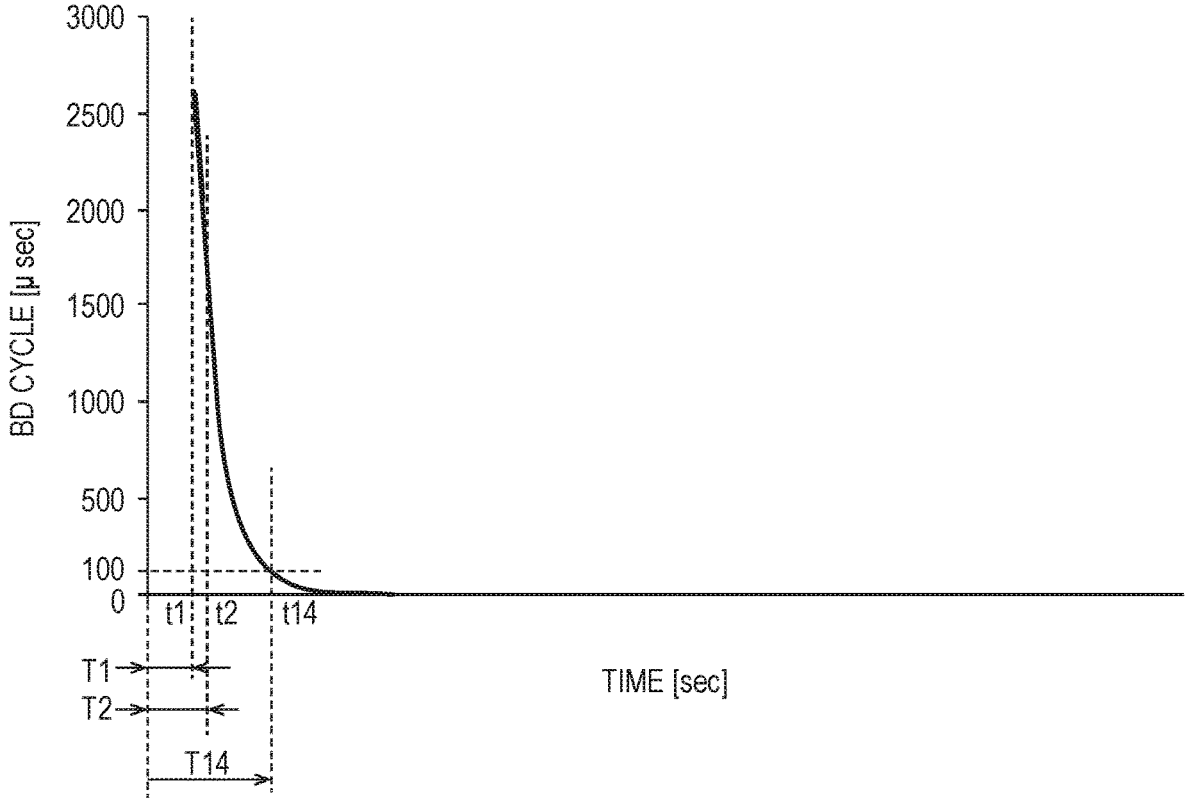
FIG. 5A is a graph illustrating the difference of the BD cycle of Example 2.
Figure 5B:
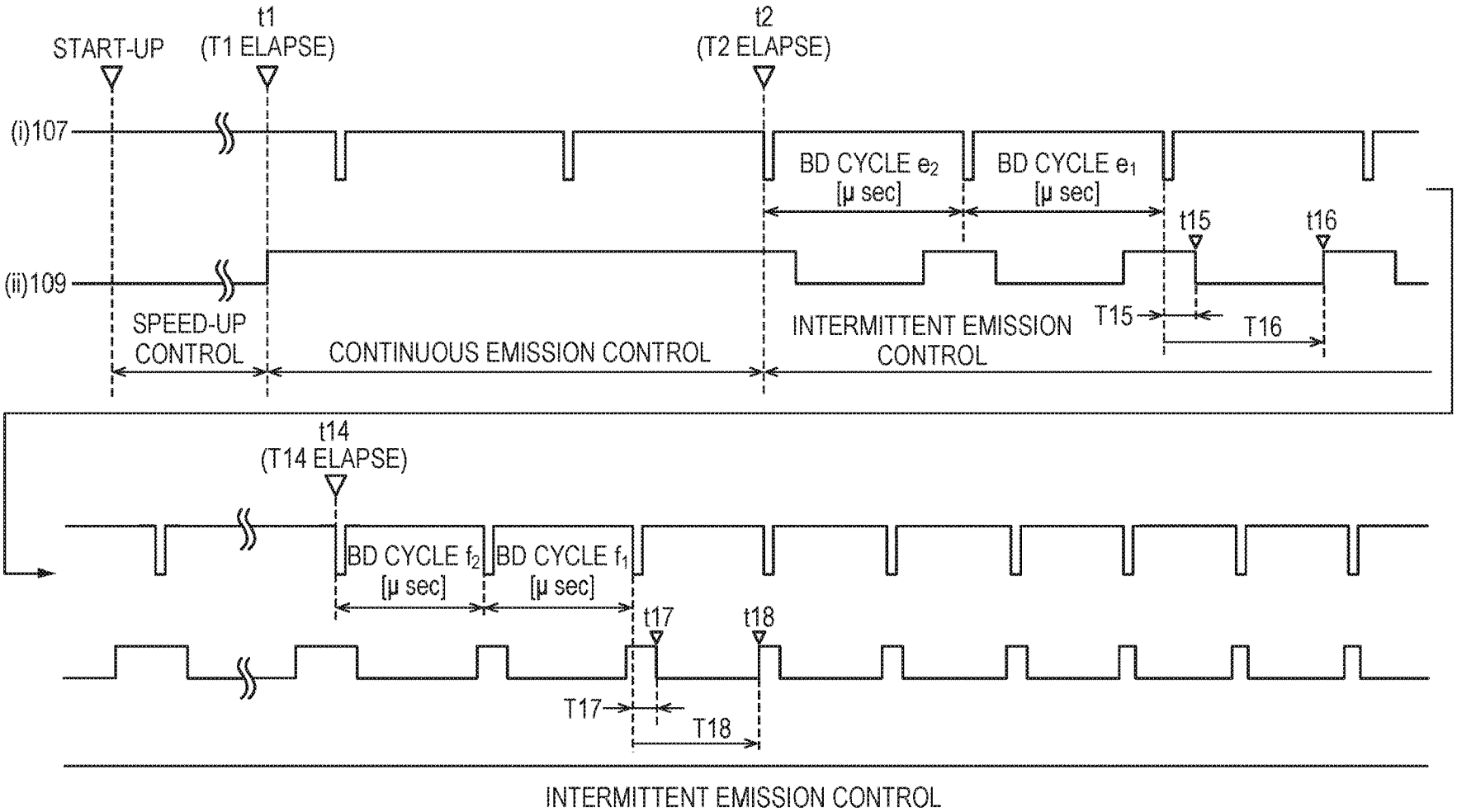
FIG. 5B is a timing chart illustrating the waveforms of the BD signal and the laser driving signal.

Using FIG. 5A and FIG. 5B, the operation of start-up control from the state where the scanner motor 103 in Example 2 is stopped is described. FIG. 5A is a characteristic diagram illustrating the change of the difference of the BD cycle in a case where the scanner motor 103 is started up from the state where the scanner motor 103 is stopped. As indicated by Formula (5), the difference of the BD cycle indicates the difference between the BD cycle at the scan at the time before last ($e_2$ of FIG. 5B) and the BD cycle at the last scan ($e_1$ of FIG. 5B), i.e., the difference between the two BD cycles that are continuous in time. Additionally, similar to FIG. 2B, FIG. 5B illustrates the waveforms of the BD signal 107 and the laser driving signal 109. Further, the same signs (t1, etc.) are assigned to the timings that are the same as the timings in FIG. 2B, and a description is omitted.

Difference of the BD cycles=the BD cycle at the scan at the time before last−the time period of the BD cycle at the last scan — Formula (5)

In contrast to Example 1, the switching of the computation formulas of the emission start and end timings of the semiconductor laser 101 at the time of the intermittent emission control is performed by using the difference of the BD cycle. A description is added below about the characteristic points in Example 2. In the period from the time t2 to a time t14 illustrated in FIG. 5A and FIG. 5B, the difference of the BD cycle becomes 100 μsec or more, which is a predetermined difference. Therefore, the CPU 110 calculates a time period T15 until the emission end and a time period T16 until the emission start of the semiconductor laser 101 with Formulas (6) and (7) by using a BD cycle $e_1$ at the last scan and a BD cycle $e_2$ at the scan at the time before last. Here, specifically, the time period T15 is a time period until the laser driving signal 109 is switched from the high level to the low level since the BD signal 107 is detected, and the time t15, which is a first timing, is the timing at which the semiconductor laser 101 is turned off. The time period T16 is a time period until the laser driving signal 109 is switched from the low level to the high level since the BD signal 107 is detected. The time t16, which is a second timing, is the timing at which the semiconductor laser 101 is turned on. Additionally, the time t14 is the timing at which the time period T14 has elapsed since starting the start-up.

The time period until the emission end=(the BD cycle at the scan at the time before last−the BD cycle at the last scan)×$K_1$ — Formula (6)

The time period until the emission start=(the BD cycle at the scan at the time before last−the BD cycle at the last scan)×$K_2$ — Formula (7)

Here, $K_1$ and $K_2$ are coefficients, and as in Example 1, it is assumed that $K_1$:0.004 and $K_2$:0.93 in Example 2.

Next, after the time t14 from start-up of the scanner motor 103 in FIG. 5A, the difference of the BD cycle becomes shorter than 100 μsec. Therefore, the CPU 110 calculates a time period T17 until the emission end and a time period T18 until the emission start of the semiconductor laser 101 with Formulas (8) and (9) by using a BD cycle $f_1$ at the last scan and a BD cycle $f_2$ at the scan at the time before last. Here, specifically, the time period T17 is a time period until the laser driving signal 109 is switched from the high level to the low level since the BD signal 107 is detected, and the time t17, which is a third timing, is the timing at which the semiconductor laser 101 is turned off. The time period T18 is a time period until the laser driving signal 109 is switched from the low level to the high level since the BD signal 107 is detected. The time t18, which is a fourth timing, is the timing at which the semiconductor laser 101 is turned on.

The time period until the emission end=(the BD cycle at the scan at the time before last−the BD cycle at the last scan)×$K_3$ — Formula (8)

The time period until the emission start=(the BD cycle at the scan at the time before last−the BD cycle at the last scan)×$K_4$ — Formula (9)

Here, $K_3$ and $K_4$ are coefficients, and as in Example 1, it is assumed that $K_3$:0.011 and $K_4$:0.97 in Example 2. Further, switching of the calculation formulas may be performed multiple times during the start-up of the scanner motor 103. Additionally, the difference of the BD cycle may be obtained multiple times, and the average value of the differences in a plurality of obtained BD cycles may be used as the threshold value.

(Description of Flowchart)

Figure 6:
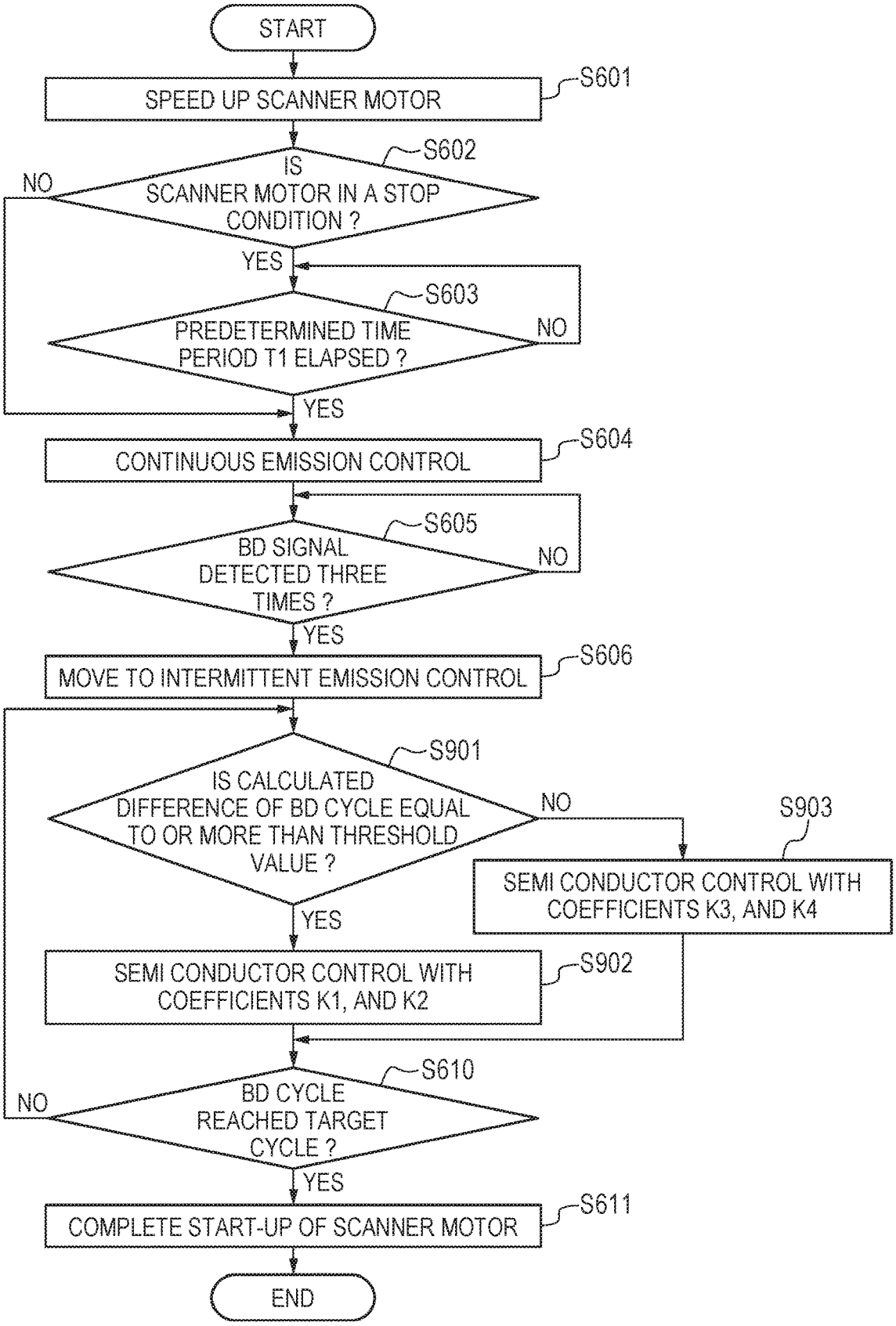
FIG. 6 is a flowchart illustrating the processing at the time of start-up of the scanning apparatus of Example 2.

Next, using the flowchart of FIG. 6, the start-up control of the scanner motor 103 by the CPU 110 in Example 2 is described. The same step numbers are attached to the same processing as the processing in the flowchart of FIG. 4, and a description is omitted. What is different from Example 1 is that, in the processing at S901, the CPU 110 determines whether or not the calculated difference of the BD cycle is equal to or more than a threshold value (for example, 100 μsec).

When the CPU 110 moves to the intermittent emission control from the continuous emission control in S606, the processing proceeds to S901. At S901, the CPU 110 calculates the difference between the BD cycle at the scan at the time before last and the BD cycle at the last scan as described above. The CPU 110 determines whether or not the calculated difference of the BD cycle is equal to or more than the threshold value. At S901, when the CPU 110 determines that the difference of the BD cycle is equal to or more than the threshold value (equal to or more than the predetermined difference), the processing proceeds to S902, and when the CPU 110 determines that that the difference of the BD cycle is less than the threshold value (less than the predetermined difference), the processing proceeds to S903.

At S902, as indicated by the above-described Formulas (6) and (7), the CPU 110 calculates the emission start and end timings (the time periods T16, T15) of the semiconductor laser 101 by using the coefficients $K_1$ and $K_2$, and performs the intermittent emission control. At S903, as indicated by the above-described Formulas (8) and (9), the CPU 110 calculates the emission start and end timings (T18, T17) of the semiconductor laser 101 by using the coefficients $K_3$ and $K_4$, and performs the intermittent emission control, and the processing proceeds to S610. Further, at S610, when the CPU 110 determines that the BD cycle has not reached the target cycle, the processing returns to S901.

As described above, by using the difference of the BD cycle, the emission start and end timings of the semiconductor laser 101 can be controlled according to the amount of change of the BD cycle. As a result, even if the speed increasing slope of the scanner motor 103 is varied due to the environmental variation or the secular change, the effects described in Example 1 can be obtained.

As described above, according to Example 2, the laser can be turned on in the area in which the horizontal synchronization signal is generated at the time of start-up of the scanning apparatus.

Example 3

In Example 3, the control in a case where the semiconductor laser 101 includes two light sources is described. Further, since the configuration of the laser scanner unit in Example 3 is similar to the configuration of the laser scanner unit in Example 1, a description is omitted. Two semiconductor lasers 101 are referred to as a semiconductor laser 101*a*, which is a first light source, and a semiconductor laser 101*b*, which is a second light source. Additionally, since Example 3 is based on the control in Example 1, the difference between Example 1 and Example 3 is mainly described.

(Description of the Operation of Performing Start-Up from the State where the Scanner Motor 103 is Stopped)

Figure 7:
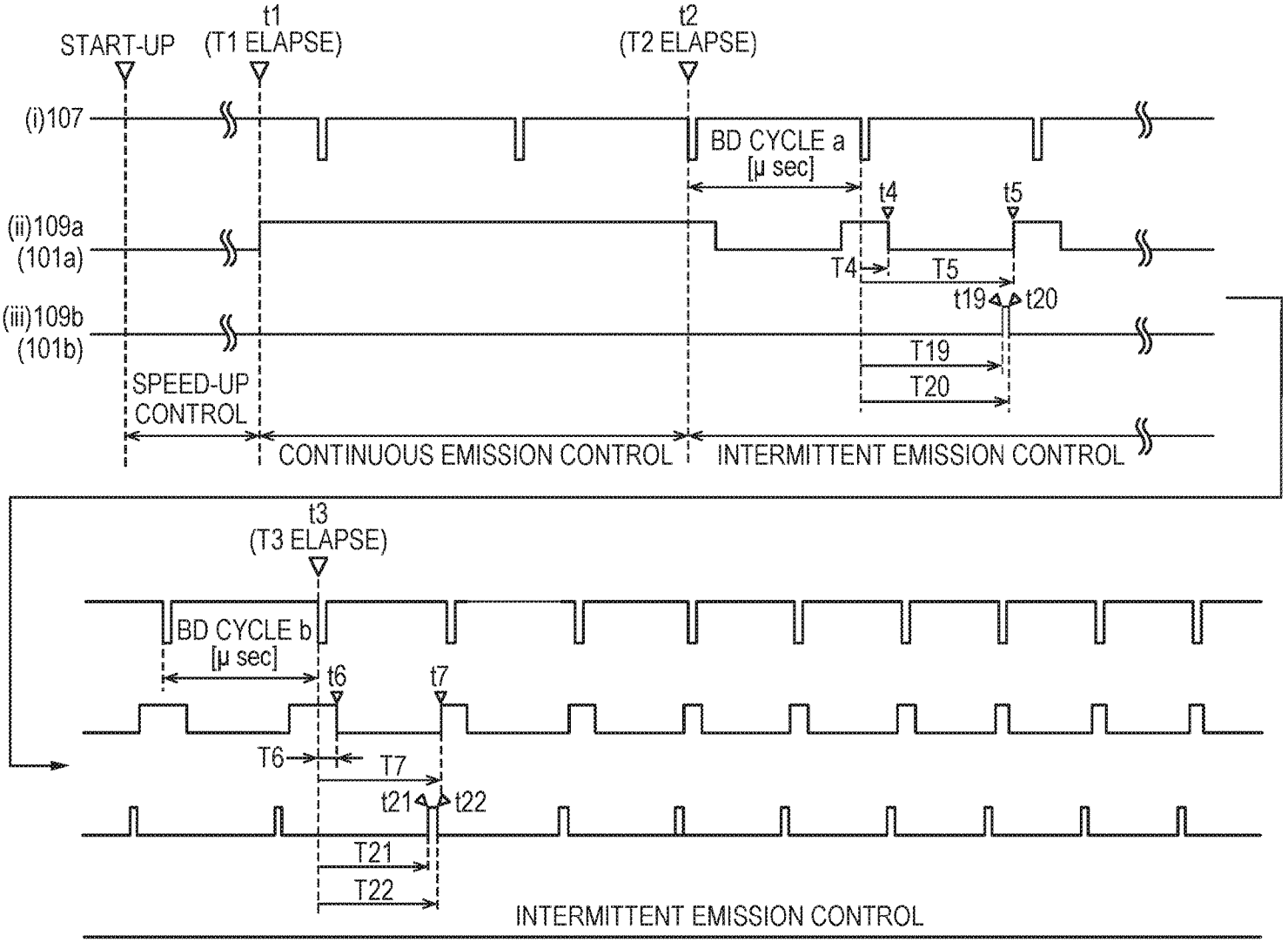
FIG. 7 is a timing chart illustrating the waveforms of the BD signal and the laser driving signal of Example 3.

Using FIG. 2A and FIG. 7, the operation of the start-up control from the state where the scanner motor 103 in Example 3 is stopped is described. Additionally, FIG. 7 illustrates the timings of the BD signal 107 and the laser driving signal 109. In contrast to Example 1, Example 3 has the configuration including laser driving signals 109*a* and 109*b* that control two light sources. Specifically, the laser driving signal 109*a* is a signal for driving the semiconductor laser 101*a*, and the laser driving signal 109*b* is a signal for driving the semiconductor laser 101*b*.

The semiconductor laser 101*a* driven by the laser driving signal 109*a* is turned on according to the generation area of the BD signal 107. Additionally, the semiconductor laser 101*b* driven by the laser driving signal 109*b* emits laser in the non-image area at the timing different from the driving timing of the semiconductor laser 101*a*. During the emission of the semiconductor laser 101*b*, the amount of light of the semiconductor laser 101*b* is adjusted by the laser drive circuit 113. A description is added below about the characteristic points in Example 3. In Example 3, the CPU 110 performs the control of the emission start and the emission end of the semiconductor laser 101*a* that is turned on for generating the BD signal 107, as well as the control of the emission start and the emission end of the semiconductor laser 101*b*, which is another light source.

In the period from the time t2 to the time t3 illustrated in FIG. 2A and FIG. 7, the BD cycle becomes 2000 μsec or more. Therefore, as in Example 1, the CPU 110 calculates the time period T4 until the emission end and the time period T5 until the emission start of the semiconductor laser 101*a* with Formulas (1) and (2). Additionally, a time period T19 until the emission start and a time period T20 until the emission end of the semiconductor laser 101*b* can be calculated by the following Formulas (10) and (11) by using the BD cycle at the last scan. Here, specifically, the time period T19 is a time period until the laser driving signal 109*b* is switched from the low level to the high level since the BD signal 107 is detected, and the time t19 is the timing at which the semiconductor laser 101*b* is turned on. The time period T20 is a time period until the laser driving signal 109*b* is switched from the high level to the low level since the BD signal 107 is detected. The time t20 is a timing at which the semiconductor laser 101*b* is turned off.

The time period until the emission start of the semiconductor laser 101*b*=the BD cycle at the last scan×$K_5$ Formula (10)

The time period until the emission end of the semiconductor laser 101*b*=the BD cycle at the last scan×$K_6$ Formula (11)

Here, $K_5$ and $K_6$ are coefficients, and it is assumed that $K_5$:0.91 and $K_6$:0.92 in Example 3. Additionally, as for the coefficients, values that are in the non-image area and do not overlap with the light-emitting timing of the semiconductor laser 101*a* are set. For example, setting is performed such that the coefficient $K_5$<the coefficient $K_2$, and the coefficient $K_6$<the coefficient $K_2$. Additionally, the setting is performed such that the coefficient $K_1$<the coefficient $K_5$, and the coefficient $K_1$<the coefficient $K_6$.

Next, after the time t3 from the start-up of the scanner motor 103 in FIG. 2A and FIG. 7, the BD cycle becomes shorter than 2000 μsec. Therefore, as in Example 1, the CPU 110 calculates the time period T6 until the emission end and the time period T7 until the emission start of the semiconductor laser 101 with Formulas (3) and (4). Additionally, a time period T21 until the emission start and a time period T22 until the emission end of the semiconductor laser 101*b* can be calculated by the following Formulas (12) and (13) by using the BD cycle b at the last scan. Here, specifically, the time period T21 is a time period until the laser driving signal 109*b* is switched from the low level to the high level since the BD signal 107 is detected, and the time t21 is the timing at which the semiconductor laser 101*b* is turned on. The time period T22 is a time period until the laser driving signal 109*b* is switched from the high level to the low level since the BD signal 107 is detected. The time t22 is the timing at which the semiconductor laser 101*b* is turned off.

The time period until the emission start of the semiconductor laser 101*b*=the BD cycle at the last scan×$K_7$ Formula (12)

The time period until the emission end of the semiconductor laser 101*b*=the BD cycle at the last scan×$K_5$ Formula (13)

Here, $K_7$ and $K_8$ are coefficients, and it is assumed that $K_7$:0.090 and $K_8$:0.96 in Example 3. Additionally, as for the coefficients, values that are in the non-image area and do not overlap with the light-emitting timing of the semiconductor laser 101*a* are set. For example, setting is performed such that the coefficient $K_7$<the coefficient $K_4$, and the coefficient $K_5$<the coefficient $K_4$. Additionally, setting is performed such that the coefficient $K_3$<the coefficient $K_7$, and the coefficient $K_3$<the coefficient $K_5$.

In Example 3, the calculation formula of the emission end time of the semiconductor laser 101*b* is switched so as to match the timing at which the calculation formula of the emission start time of the semiconductor laser 101*a* is switched. Additionally, control is performed such that the coefficient $K_6$<the coefficient $K_2$, and the coefficient $K_8$<the coefficient $K_4$, in order to turn off the semiconductor laser 101*b* earlier than the emission start timing of the semiconductor laser 101*a*. Further, by making the coefficient $K_7$<the coefficient $K_5$, the emission area of the semiconductor laser 101*b* is controlled to be narrow in the early stage of start-up of the scanner motor 103, and the laser emission to the image area is avoided.

(Description of Flowchart)

Figure 8:
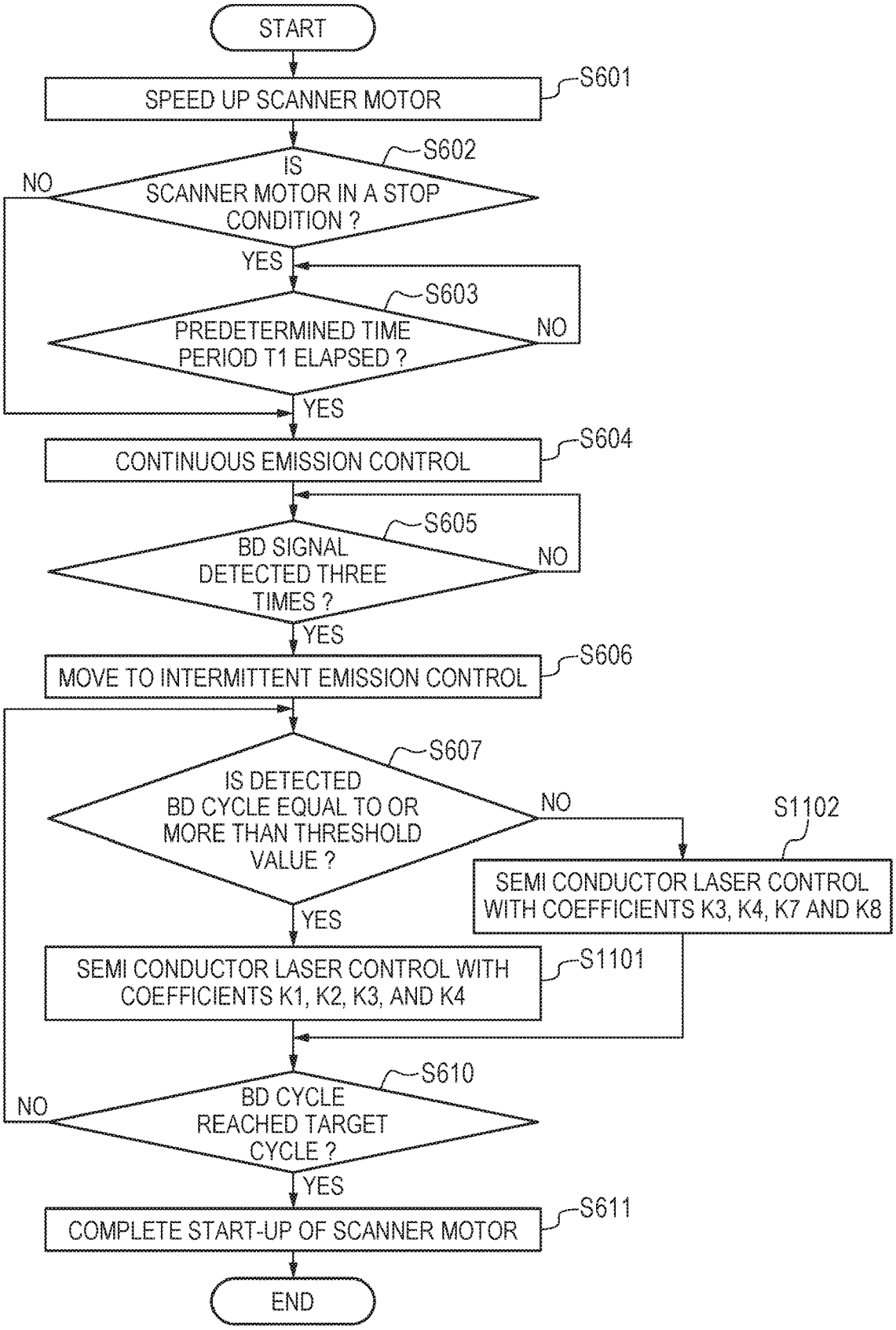
FIG. 8 is a flowchart illustrating the processing at the time of start-up of the scanning apparatus of Example 3.

Next, using the flowchart of FIG. 8, the start-up control of the scanner motor by the CPU 110 in Example 3 is described. The same step numbers are attached to the same processing as the processing in the flowchart (FIG. 4) in Example 1, and a description is omitted. What is different from Example 1 is that, in steps S1101 and S1102, the semiconductor laser 101*b* as well as the semiconductor laser 101*a* are controlled.

At S607, when the CPU 110 determines that the detected BD cycle is equal to or more than the threshold value, the processing proceeds to S1101, and when the CPU 110 determines that the BD cycle is less than the threshold value, the processing proceeds to S1102. At S1101, as indicated by Formulas (1) and (2), the CPU 110 calculates the emission start and end timings of the semiconductor laser 101*a* by using the coefficients $K_1$ and $K_2$, and performs the intermittent emission control. Further, as indicated by Formulas (10) and (11), the CPU 110 calculates the emission start and end timings of the semiconductor laser 101*b* by using the coefficient $K_5$ and $K_6$, and performs the intermittent emission control.

At S1102, as indicated by Formulas (3) and (4), the CPU 110 calculates the emission start and end timings of the semiconductor laser 101*a* by using the coefficients $K_3$ and $K_4$, and performs the intermittent emission control. Further, as indicated by Formulas (12) and (13), the CPU 110 calculates the emission start and end timings of the semiconductor laser 101*b* by using the coefficients $K_7$ and $K_8$ and performs the intermittent emission control, and the processing proceeds to S610.

As described above, according to Example 3, the calculation formulas for calculating the emission timings for the semiconductor laser 101*b* as well as the semiconductor laser 101*a* are switched according to the BD cycle at the time of start-up of the scanner motor 103. Accordingly, together with the effects in Example 1, the emission timings of the semiconductor laser 101*a* and the semiconductor laser 101*b* can be controlled so as not to overlap with each other, and further, the laser emission to the image area can be avoided also in the semiconductor laser 101*b*. Further, the configuration including the two semiconductor lasers 101*a* and 101*b* may be applied to Example 2 (the intermittent emission control based on the difference of the BD cycle).

As described above, according to Example 3, the laser can be turned on in the area in which the horizontal synchronization signal is generated at the time of start-up of the scanning apparatus.

Example 4

In contrast to Example 3, in Example 4, the control in a case where the emission of the semiconductor laser 101*b* is performed after the emission of the semiconductor laser 101*a* is described. Further, since the configuration of the laser scanner unit in Example 4 is similar to the configuration of the laser scanner unit in Example 1, a description is omitted. Additionally, since Example 4 is based on the control in Example 1, the difference between Example 1 and Example 4 is mainly described.

(Description of the Operation of Performing Start-Up from the State where the Scanner Motor 103 is Stopped)

Figure 9:
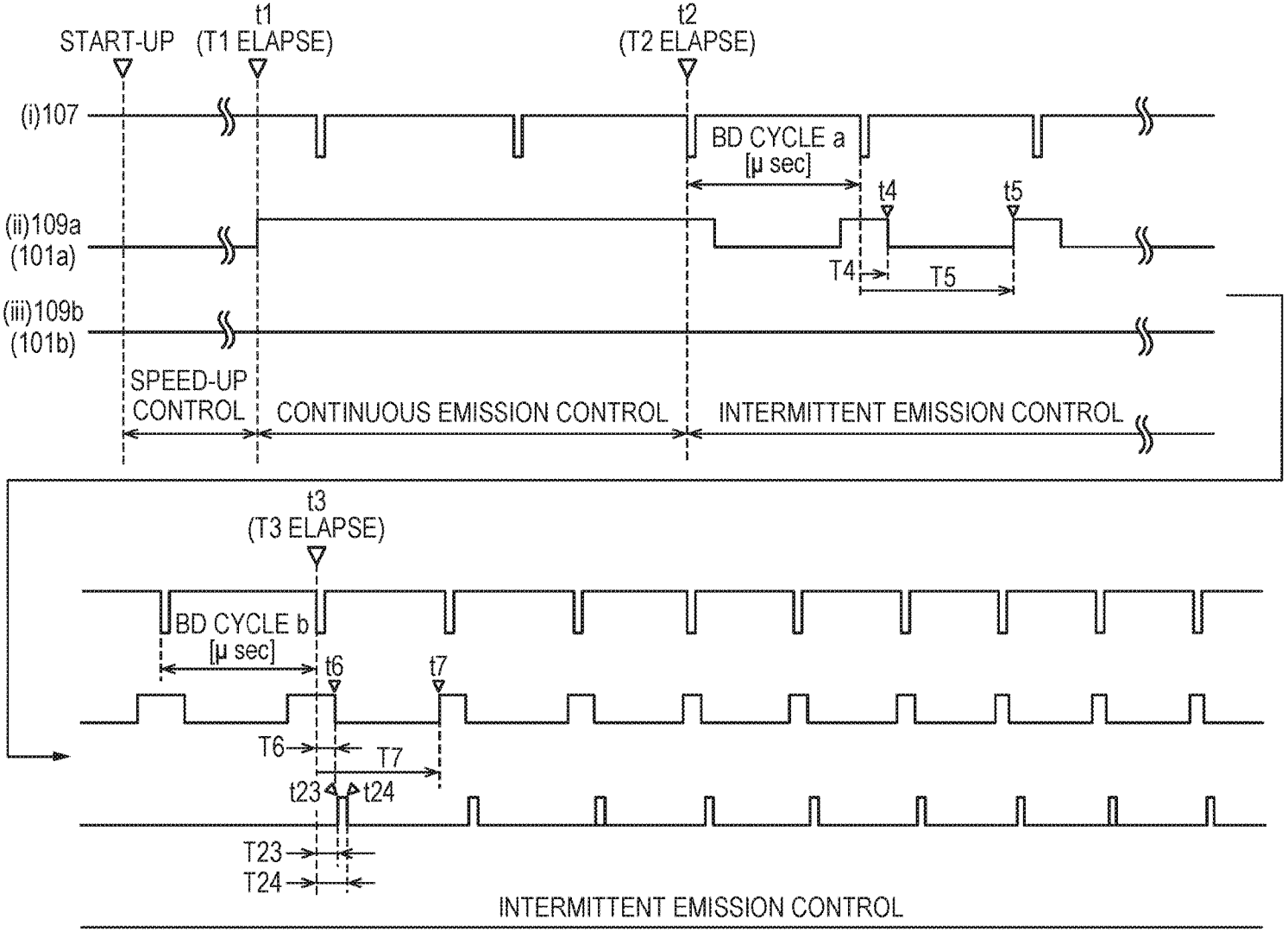
FIG. 9 is a timing chart illustrating the waveforms of the BD signal and the laser driving signal of Example 4.

Using FIG. 2A and FIG. 9, the operation of the start-up control from the state where the scanner motor 103 in Example 4 is stopped is described. FIG. 9 is a diagram similar to FIG. 7. The characteristic points in Example 4 are described below. In the period from the time t2 to the time t3 illustrated in FIG. 2A and FIG. 9, the BD cycle becomes 2000 μsec or more. In Example 4, the emission of the semiconductor laser 101*b* is prohibited in that period.

Next, after the time t3 from the start-up of the scanner motor 103 of FIG. 2A and FIG. 8, the BD cycle becomes shorter than 2000 μsec. Therefore, as in Example 1, the CPU 110 calculates the time period T6 until the emission end and the time period T7 until the emission start of the semiconductor laser 101 with Formulas (3) and (4). Additionally, a time period T23 until the emission start and a time period T24 until the emission end of the semiconductor laser 101*b* are calculated by the following Formulas (14) and (15) by using the BD cycle b at the last scan. Here, specifically, the time period T23 is a time period until the laser driving signal 109*b* is switched from the low level to the high level since the BD signal 107 is detected, and the time t23 is the timing at which the semiconductor laser 101*b* is turned on. The time period T24 is a time period until the laser driving signal 109*b* is switched from the high level to the low level since the BD signal 107 is detected. The time t24 is the timing at which the semiconductor laser 101*b* is turned off.

The time period until emission start of the semiconductor laser 101*b*=the BD cycle at the last scan×$K_9$ Formula (14)

The time period until emission end of the semiconductor laser 101*b*=the BD cycle at the last scan×$K_{10}$ Formula (15)

Here, $K_9$ and $K_{10}$ are coefficients, and it is assumed that $K_9$:0.015 and $K_{10}$:0.1 in Example 4.

In Example 4, the emission control of the semiconductor laser 101*b* is switched so as to match the timing at which the calculation formula of the emission start time of the semiconductor laser 101*a* is switched. Additionally, in order to turn on the semiconductor laser 101*b* after turning off the semiconductor laser 101*a*, it is assumed that the coefficient $K_3$<the coefficient $K_9$. Further, by controlling the semiconductor laser 101*b* so as not to be turned on in the early stage of start-up of the scanner motor 103, the semiconductor laser 101*b* is prevented from being turned on in the image area.

(Description of Flowchart)

Figure 10:
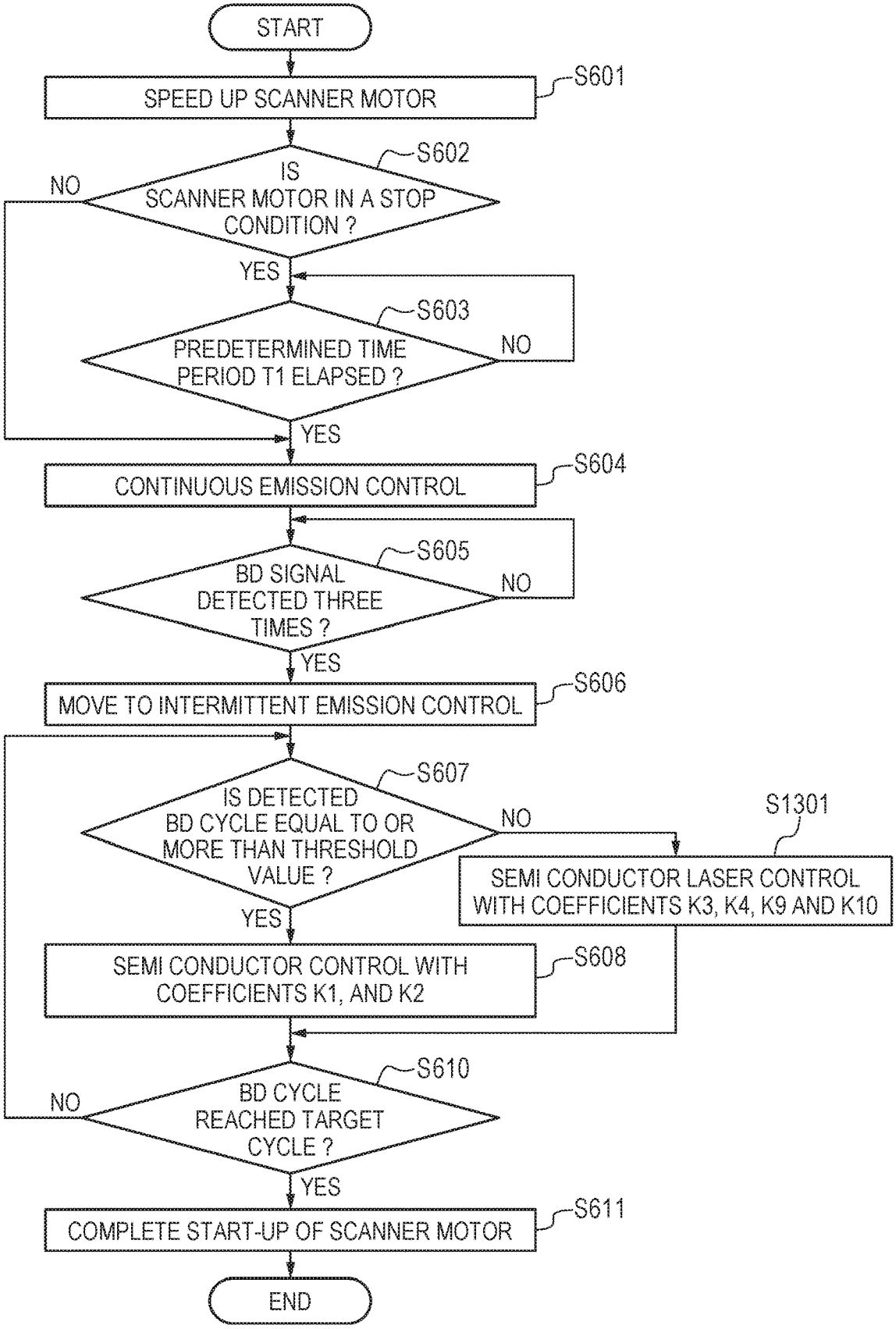
FIG. 10 is a flowchart illustrating the processing at the time of start-up of the scanning apparatus of Example 4.

Next, using the flowchart of FIG. 10, the start-up control of the scanner motor 103 by the CPU 110 in Example 4 is described. The same step numbers are attached to the same processing as the processing in the flowchart (FIG. 4) in Example 1, and a description is omitted. What is different from Example 1 is S1301.

At S607, the CPU 110 determines whether or not the BD cycle is equal to or more than the threshold value (for example, equal to or more than 2000 μsec), and when the CPU 110 determines that the BD cycle is equal to or more than the threshold value, the processing proceeds to S608, and when the CPU 110 determines that the BD cycle is less than the threshold value, the processing proceeds to S1301. At S608, as indicated by Formulas (1) and (2), the CPU 110 calculates the emission start and end timings of the semiconductor laser 101*a* by using the coefficients $K_1$ and $K_2$, and performs the intermittent emission control. Further, at S608, the CPU 110 controls the semiconductor laser 101*b* so as not to be turned on.

At S1301, as indicated by Formulas (3), (4), (14) and (15), the CPU 110 calculates the emission start and end timings of the semiconductor laser 101*a* and the semiconductor laser 101*b* with the coefficients $K_3$, $K_4$, $K_9$ and $K_{10}$. The CPU 110 performs the intermittent emission control according to the calculated timing, and the processing proceeds to S610.

As described above, according to Example 4, in a case where the semiconductor laser 101*b* is turned on after the semiconductor laser 101*a*, the semiconductor laser 101*b* is controlled to be turned on so as to match the emission end timing of the semiconductor laser 101*a*. Accordingly, together with the effects in Example 1, the emission timings of the semiconductor laser 101*a* and the semiconductor laser 101*b* can be controlled so as not to overlap with each other. Additionally, by controlling the semiconductor laser 101*b* so as not to be turned on in the early stage of start-up of the scanner motor 103, the laser emission to the image area can be avoided.

Additionally, although the case where the two semiconductor lasers 101*a* and 101*b* are provided is described in Examples 3 and 4, the number of the semiconductor lasers 101 may be more than two. In this case, the laser light emitted from one semiconductor laser is input to the horizontal synchronization sensor 106, and the laser light emitted from another semiconductor laser is not input to the horizontal synchronization sensor 106. Additionally, in a case where the number of the monitor elements included in the laser drive circuit 113 is one, the amount of light is adjusted in the state where only one semiconductor laser is turned on.

As described above, according to Example 4, the laser can be turned on in the area in which the horizontal synchronization signal is generated at the time of start-up of the scanning apparatus.

According to the present invention, the laser can be turned on in the area in which the horizontal synchronization signal is generated at the time of start-up of the scanning apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-096082, filed May 18, 2018, which is hereby incorporated by reference herein in its entirety.

What is claimed is:

1. A scanning apparatus comprising:

a light source configured to emit laser light for forming an electrostatic latent image according to image data onto a photosensitive member;

a rotary polygon mirror configured to scan the laser light emitted from the light source by rotation;

an output unit arranged in a second area except for a first area corresponding to an area in which the electrostatic latent image is formed in an area to which the laser light is scanned, the output unit configured to output a signal in response to emission of the laser light; and a control unit configured to perform intermittent emission control in which the light source emits a laser light in the area in which the laser light is emitted to the output unit, based on a cycle of the signal output by the output unit;

wherein the control unit switches the intermittent emission control based on the signal by a time the rotary polygon mirror reaches a target rotation speed, wherein in a case where the cycle of the signal is equal to or more than a predetermined cycle, the control unit turns off the light source at a first timing later than a timing at which the signal is output, and turns on the light source at a second timing earlier than the timing at which the signal is output, and wherein in a case where the cycle of the signal is less than the predetermined cycle, the control unit turns off the light source at a third timing later than the timing at which the signal is output, and earlier than the first timing, and turns on the light source at a fourth timing earlier than the timing at which the signal is output, and later than the second timing.

2. A scanning apparatus according to claim 1, wherein in the case where the cycle of the signal is equal to or more than the predetermined cycle, the control unit turns off the light source at a timing obtained by multiplying the cycle of the signal by a first coefficient, and turns on the light source at a timing obtained by multiplying the cycle of the signal by a second coefficient that is smaller than 1 and larger than the first coefficient, and wherein in the case where the cycle of the signal is less than the predetermined cycle, the control unit turns off the light source at a timing obtained by multiplying the cycle of the signal by a third coefficient that is larger than the first coefficient, and turns on the light source at a timing obtained by multiplying the cycle of the signal by a fourth coefficient that is larger than the second coefficient.

3. A scanning apparatus according to claim 1, wherein the light source includes a first light source and a second light source, wherein the control unit:

performs the intermittent emission control on the first light source so that laser light emitted from the first light source is emitted to the output unit, controls the second light source so as not to cause the laser light emitted from the second light source to be emitted to the output unit, and controls the second light source to be turned on in the second area so that both of the first light source and the second light source are not turned on.

4. A scanning apparatus according to claim 1, wherein the light source includes a first light source and a second light source, and wherein the control unit:

performs the intermittent emission control to the first light source so that laser light emitted from the first light source is emitted to the output unit, and in the case where the cycle of the signal is equal to or more than the predetermined cycle, turns off the second light source, and in the case where the cycle of the signal is less than the predetermined cycle, controls the second light source so as not to cause the laser light emitted from the second light source to be emitted to the output unit, and controls the second light source to be turned on in the second area so that both of the first light source and the second light source are not turned on.

5. A scanning apparatus according to claim 1, wherein the control unit switches the intermittent emission control based on a difference between two continuous cycles based on the signal output by the output unit by a time the rotary polygon mirror reaches the target rotation speed.

6. A scanning apparatus according to claim 5, wherein in a case where the difference is equal to or more than a predetermined difference, the control unit turns off the light source at a first timing later than a timing at which the signal is output, and turns on the light source at a second timing earlier than the timing at which the signal is output, and wherein in a case where the difference is less than the predetermined difference, the control unit turns off the light source at a third timing later than the timing at which the signal is output, and earlier than the first timing, and turns on the light source at a fourth timing earlier than the timing at which the signal is output, and later than the second timing.

7. A scanning apparatus according to claim 6, wherein in the case where the difference is equal to or more than the predetermined difference, the control unit turns off the light source at a timing obtained by multiplying the difference by a first coefficient, and turns on the light source at a timing obtained by multiplying the difference by a second coefficient that is smaller than one, and is larger than the first coefficient, and wherein in the case where the difference is less than the predetermined difference, the control unit turns off the light source at a timing obtained by multiplying the difference by a third coefficient larger than the first coefficient, and turns on the light source at a timing obtained by multiplying the difference by a fourth coefficient larger than the second coefficient.

8. A scanning apparatus according to claim 6, wherein the light source includes a first light source and a second light source, and wherein the control unit:

performs the intermittent emission control of the first light source so that laser light emitted from the first light source is emitted to the output unit, and controls the second light source so as not to cause the laser light emitted from the second light source to be emitted to the output unit, and controls the second light source to be turned on in the second area so that both of the first light source and the second light source are not turned on.

9. A scanning apparatus according to claim 6, wherein the light source includes a first light source and a second light source, wherein the control unit performs the intermittent emission control of the first light source so that laser light emitted from the first light source is emitted to the output unit, and wherein in the case where the difference is equal to or more than the predetermined difference, the control unit turns off the second light source, and in the case where the difference is less than the predetermined difference, the control unit controls the second light source so as not to cause the laser light emitted from the second light source to be emitted to the output unit, and controls the second light source to be turned on in the second area so that both of the first light source and the second light source are not turned on.

10. A scanning apparatus according to claim 1, wherein the light source includes a monitor element configured to receive the laser light that is emitted, wherein the scanning apparatus comprises an adjustment unit configured to adjust an amount of light of the light source based on the laser light received by the monitor element, and wherein the adjustment unit adjusts the amount of light of the light source by turning on the light source in the second area.

11. A scanning apparatus according to claim 1, wherein in a case of controlling the rotary polygon mirror so that the rotation speed reaches the target rotation speed by starting rotation from a state where the rotary polygon mirror is stopped, the control unit performs continuous emission control that continuously turns on the light source after a predetermined time elapses since the rotation of the rotary polygon mirror is started.

12. A scanning apparatus according to claim 1, wherein in a case of controlling the rotary polygon mirror so that the rotation speed reaches the target rotation speed from a state where the rotary polygon mirror is not stopped, the control unit performs continuous emission control that continuously turns on the light source.

13. A scanning apparatus according to claim 11, wherein the control unit switches the continuous emission control to the intermittent emission control at a timing at which the signal is output from the output unit a predetermined number of times since the continuous emission control is started.

14. A scanning apparatus according to claim 12, wherein the control unit switches the continuous emission control to the intermittent emission control at a timing at which the signal is output from the output unit a predetermined number of times since the continuous emission control is started.

15. A scanning apparatus according to claim 1, wherein a cycle of the signal becomes shorter as the rotation speed of the rotary polygon mirror increases toward the target rotation speed.

16. An image forming apparatus comprising:

a scanning apparatus;

a photosensitive member on which an electrostatic latent image is formed by scanning laser light by the scanning apparatus;

a developing unit configured to develop the electrostatic latent image formed on the photosensitive member with a toner, and to form a toner image; and a transfer unit configured to transfer the toner image formed by the developing unit to a recording material, the scanning apparatus comprising:

a light source configured to emit the laser light for forming the electrostatic latent image according to image data onto the photosensitive member;

a rotary polygon mirror configured to scan the laser light emitted from the light source by rotation;

an output unit arranged in a second area except for a first area corresponding to an area in which the electrostatic latent image is formed in an area to which the laser light is scanned, the output unit being configured to output a signal in response to emission of the laser light; and a control unit configured to perform intermittent emission control in which the light source emits a laser light in the area in which the laser light is emitted to the output unit, based on a cycle of the signal output by the output unit, wherein the control unit switches the intermittent emission control based on the signal by a time the rotary polygon mirror reaches a target rotation speed, wherein in a case where the cycle of the signal is equal to or more than a predetermined cycle, the control unit turns off the light source at a first timing later than a timing at which the signal is output, and turns on the light source at a second timing earlier than the timing at which the signal is output, and wherein in a case where the cycle of the signal is less than the predetermined cycle, the control unit turns off the light source at a third timing later than the timing at which the signal is output, and earlier than the first timing, and turns on the light source at a fourth timing earlier than the timing at which the signal is output, and later than the second timing.

17. A scanning apparatus comprising:

a light source configured to emit laser light for forming an electrostatic latent image according to image data onto a photosensitive member;

a rotary polygon mirror configured to scan the laser light emitted from the light source by rotation;

an output unit arranged in a second area except for a first area corresponding to an area in which the electrostatic latent image is formed in an area to which the laser light is scanned, the output unit configured to output a signal in response to emission of the laser light; and a control unit configured to perform intermittent emission control in which the light source emits a laser light in the area in which the laser light is emitted to the output unit, based on a cycle of the signal output by the output unit;

wherein the control unit switches the intermittent emission control based on the signal by a time the rotary polygon mirror reaches a target rotation speed, wherein in a case where the cycle of the signal is first cycle, the control unit turns off the light source at a first timing later than a timing at which the signal is output, and turns on the light source at a second timing earlier than the timing at which the signal is output, and wherein in a case where the cycle of the signal is second cycle less than the first cycle, the control unit turns off the light source at a third timing later than the timing at which the signal is output, and earlier than the first timing, and turns on the light source at a fourth timing earlier than the timing at which the signal is output, and later than the second timing.

* * * * *